United States Patent [19]

LaCapria

[11] 4,066,280

[45] Jan. 3, 1978

[54] DOCUMENTS OF VALUE PRINTED TO PREVENT COUNTERFEITING

[75] Inventor: Anthony LaCapria, Brooklyn, N.Y.

[73] Assignee: American Bank Note Company, New York, N.Y.

[21] Appl. No.: 693,921

[22] Filed: June 8, 1976

[51] Int. Cl.[2] ..... B42D 15/00

[52] U.S. Cl. ..... 283/8 R; 427/7; 250/461 R

[58] Field of Search ..... 283/8 R, 8 B; 428/916; 427/7; 250/461; 355/71, 11

[56] References Cited

U.S. PATENT DOCUMENTS

| | | | |
|---|---|---|---|
| 3,713,861 | 1/1973 | Sharp | 427/7 |
| 3,852,088 | 12/1974 | Godlewski et al. | 283/8 B X |
| 3,928,226 | 12/1975 | McDonough et al. | 250/461 X |

FOREIGN PATENT DOCUMENTS

| | | |
|---|---|---|
| 320,596 | 4/1920 | Germany. |

*Primary Examiner*—Stephen C. Pellegrino
*Attorney, Agent, or Firm*—Cooper, Dunham, Clark, Griffin & Moran

[57] ABSTRACT

These documents of value are printed so as to prevent copying, and particularly the counterfeiting of documents of value, with the aid of modern color copiers. For that purpose, part of the material on the document is printed in an ink containing a specularly reflective coloring material, for example, powdered aluminum. The modern color copiers depend upon a color analysis of the light absorbed by various parts of the document, and do not reproduce true colors when they encounter specular reflections from the surface of the document being copied. A specular reflection on the surface of the document being copied results in a product from the color copier which does not faithfully follow the colors on the original document, and hence is readily distinguishable from an original.

7 Claims, 11 Drawing Figures

Fig. 1.
PRIOR ART
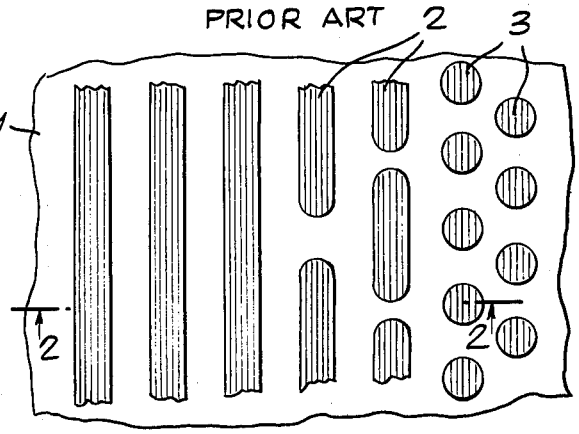
Fig. 2.
PRIOR ART
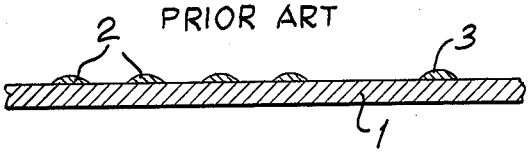
Fig. 3.
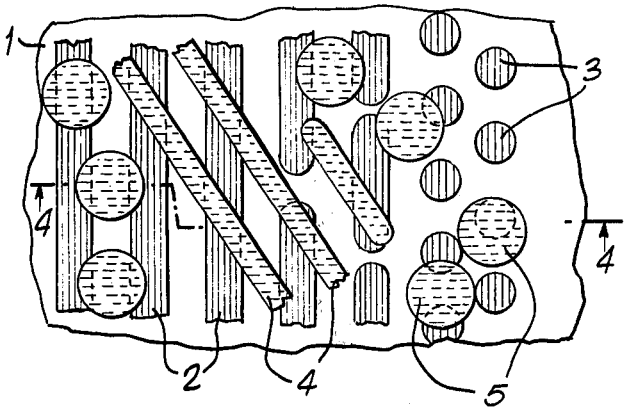
Fig. 4.
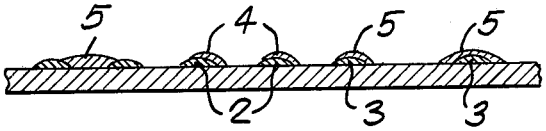
Fig. 7.
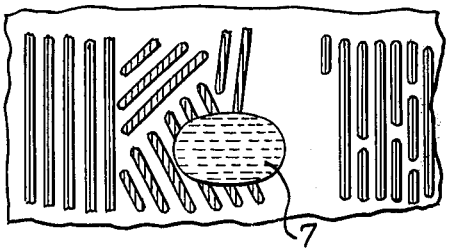
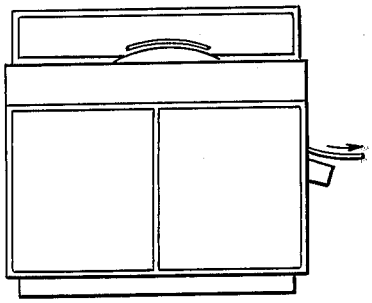
Fig. 5.
Fig. 6.
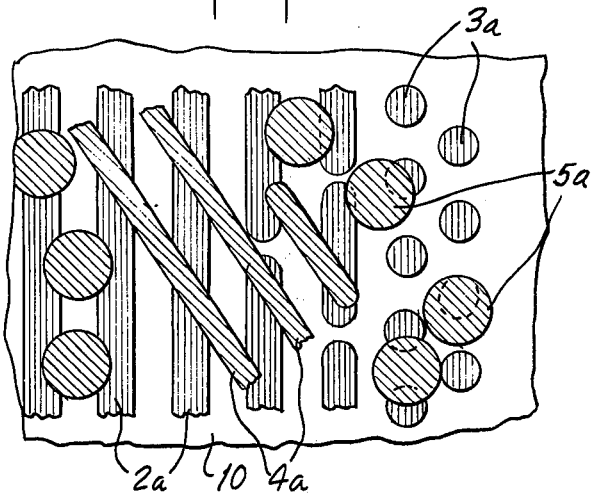

Fig. 8.
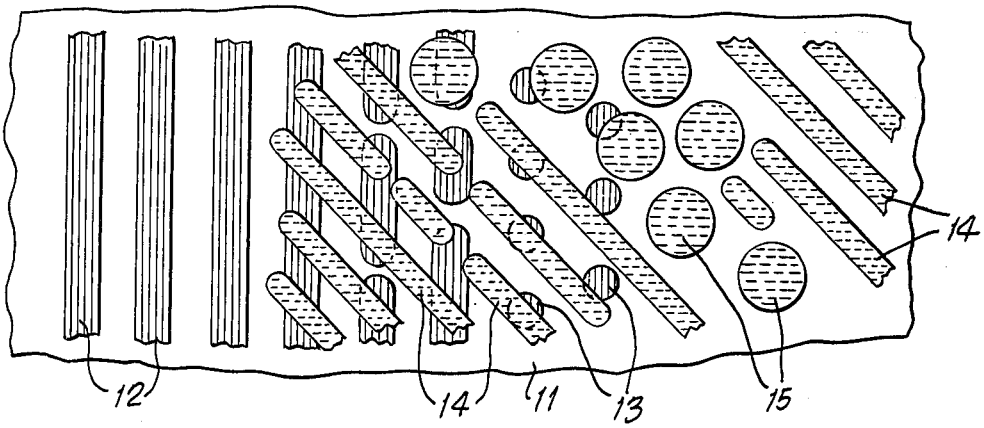
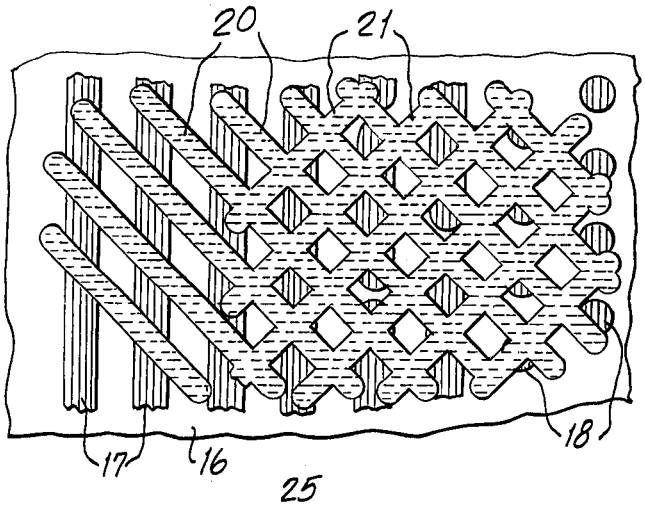
Fig. 9.
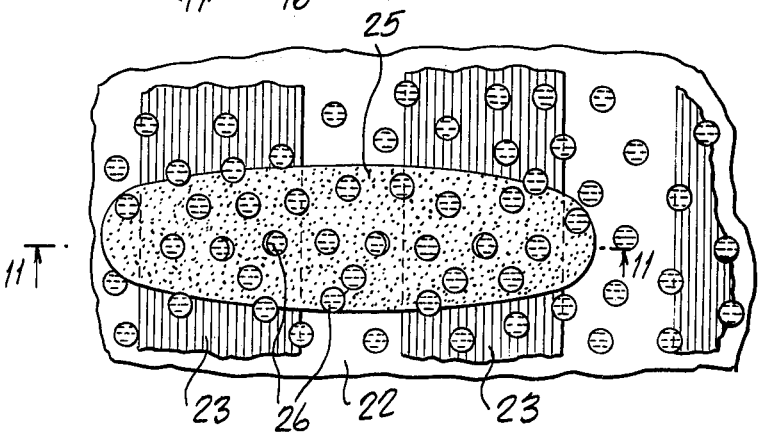
Fig. 10.
Fig. 11.
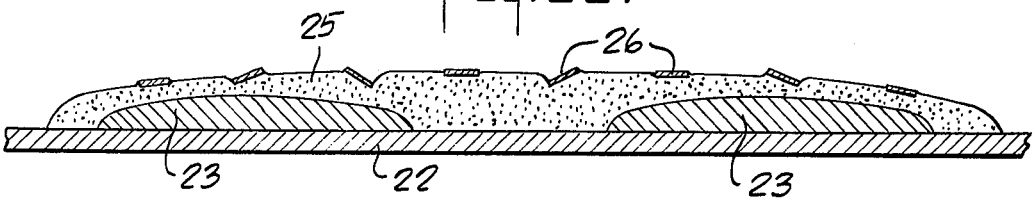

DOCUMENTS OF VALUE PRINTED TO PREVENT COUNTERFEITING

BRIEF SUMMARY

Documents printed in accordance with this invention have two overlapping imprints, which are not in register. One imprint, which may be in one or several colors, usually includes most of the material printed on the document. This imprint is in conventional coloring materials, e.g., pigments which are light absorptive. The second imprint is made in an ink including a specularly reflective coloring material. The second imprint either overlaps or is overlapped by part of the first imprint. The second imprint comprises a multiplicity of fine, closely spaced marks, e.g., dots or lines, which are difficult to reproduce by hand.

DRAWINGS

FIG. 1 is a fragmentary plan view on an enlarged scale, of a document of value including a conventional imprint.

FIG. 2 is a cross-sectional view taken on the line 2—2 of FIG. 1.

FIG. 3 is a plan view of the document of FIG. 1, after a second imprint has been applied in accordance with the invention.

FIG. 4 is a cross-sectional view on the line 4—4 of FIG. 3.

FIG. 5 is a stylized elevational view of a color copier.

FIG. 6 is a plan view of a product of the copier of FIG. 5, made in attempting to reproduce the document of FIG. 3.

FIG. 7 is a fragmentary plan view, on a smaller scale, of the document of FIG. 3.

FIG. 8 is a fragmentary plan view of another document showing a different array of two imprints.

FIG. 9 is a fragmentary plan view of still another document showing a different array of two imprints.

FIG. 10 is a still further magnified view, illustrating aluminum flakes in the overprint.

FIG. 11 is a cross-sectional view on the line 10—10 of FIG. 10 on an enlarged scale.

DETAILED DESCRIPTION

FIGS. 1-7

These figures show a fragment of a document 1 having printed thereon a first conventional imprint consisting of lines 2 and dots 3 and a second imprint in accordance with the invention consisting of lines 4 and dots 5. The lines 2 and dots 3 are color coded for red. The lines 4 and dots 5 are color coded for silver.

The imprint 2, 3 may be made with any conventional printing ink using a pigment or other suitable coloring matter. While the lines and dots illustrated are raised, as is characteristic of intaglio printing, the invention is equally applicable to other types of printing. The lines 4 and dots 5 are made with an ink employing a pigment including powdered aluminum so as to impart to the lines 4 and dots 5 a silver color.

Either the imprint 2, 3 or the imprint 4, 5 may be applied by lithographic, letter press, or intaglio printing. The two imprints do not have to be made by the same method of printing. The method of printing selected for one imprint is completely independent of the method of printing used for the other imprint.

The two imprints may be applied successively as part of the same printing process. The imprint with the aluminum pigment may also be applied to documents on which the first imprint was applied months or years prior to the later imprint.

When the document shown in FIG. 3 is passed through a color copier, such as the one shown in a stylized form at 6 in FIG. 5, the product of the copier appears as shown at 10 in FIG. 6. The lines and dots 3 of FIG. 3, where not overprinted, reproduce correctly as lines **2*a* and dots 3*a* in their original red color. However, the silver lines 4 and dots 5 of FIG. 3 reproduce as some other color, usually blue or green. Lines 4*a* and dots 5*a* are coded as green in FIG. 6. Hence, a copy of the document 1 made with the color copier 6** may be readily recognized as a copy and hence as a counterfeit, by the presence of green lines and dots where there should be silver lines and dots. Some copiers may reproduce silver as black, and some may simply fail to reproduce it, depending on the characteristics of the copier.

It is preferred to make the lines 4 and dots 3 fine and closely spaced, so that they cannot be reproduced by hand, except with great difficulty. A counterfeiter using a color copier is seeking an easy way to make a reproduction and will not take the trouble to reproduce the fine lines and dots by hand in aluminum or other silver colored pigments. If the silver colored pigment were applied over a wide area rather than in fine lines and dots, it would be relatively easy to copy by means of a brush.

To prevent manual copying, the width of the lines may be about 0.01 inch. The spacing between the lines may also be about 0.01 inch. These dimensions as to line width and line spacing are not critical, but may be varied over a wide range. It is desirable that the material printed in aluminum pigment be complex, preferably with curved lines. It should preferably be of the type sometimes known as "medallion" printing, i.e., a human face or figure, or a scene, which will give a strange appearance to the eye if not faithfully reproduced. The aluminum pigment imprint should include a solid area, as shown at 7 in FIG. 7, i.e., an area of solid color having substantial dimensions in two directions, so that a silver colored specular reflection may be readily observed on the genuine document.

It is preferred that the imprints overlap but do not register. The overlap may be an overlap of the silver color over the conventional color, as shown, or the conventional color may overlap the silver.

The silver colored imprint by itself will prevent counterfeiting by color copiers. If that imprint overlaps with a different colored imprint, then it becomes very difficult to reproduce the document photographically, as, for example in lithographic reproduction. The imprint which overlaps or is overlapped by the silver imprint should preferably be black for the most effective protection against counterfeiting.

All of the modern color copiers analyze the color of the document to be copied and separate the colors observed into a limited number of component primary colors, usually three. The three colors most commonly employed are yellow, cyan and magenta. The analysis by the color copier depends upon the colors absorbed by the various areas of the document surface. When the document reflects light specularly, substantially without any color absorption, the copier is not able to faithfully reproduce the specularly reflecting area.

It has been discovered that aluminum powder is typically in the form of small flakes which tend to lie flat when printed, so that they are specularly reflective. Of course, not all the aluminum flakes lie flat, but a sufficient percentage of them do so to produce scattered specular reflections. The scattered reflections, although randomly located, are sufficiently dense to confuse the copier and interfere with the reproduction of the silver color of the aluminum.

FIG. 8

FIG. 8 shows a plan view of a document 11 having a first imprint consisting of lines 12 and dots 13, both color coded for red, and a second imprint consisting of lines 14 and dots 15, both color coded for silver. Note that part of the lines 12 and dots 13 are overlapped by the second imprint 14, 15 and that part of the lines 12 and dots 13 are not overlapped. Similarly, part of the lines 14 and dots 15 do not overlap the first imprint 12, 13.

FIG. 9

In this figure there are shown a fragment of a document 16 having a first imprint including lines 17 and dots 18. The second imprint consists of a first set of lines 20 and a second set of lines 21 crossing the first set at right angles. By making the two sets of lines 20 and 21 cross, the difficulty of reproducing them by hand is increased.

FIGS. 10–11

FIGS. 10 and 11 show a document 22 with a first imprint of lines 23 and a second imprint comprising an elongated region covered by a pigment 25 including aluminum flakes 26. The aluminum powder used is of a fineness such that 95% passes a 400 mesh screen. The openings in such a screen are about 0.0015 inch square. Hence, the aluminum flakes are, for the most part, smaller than that area. It may be seen in FIG. 10 that some of the flakes 26 lie flat in the surface of the pigment and provide scattered specular reflections of light directed at the surface of the document 22.

EXAMPLE 1

The following is a suitable formulation of an ink for printing fine lines and dots in a silver color:

| part A | % by Wt. |
|---|---|
| Powdered Aluminum (95% passes 400 mesh screen) | 64 |
| Mineral Spirits | 16 |
| Transparent Varnish | 20 |
| | 100 |

| Part B | |
|---|---|
| Chinawood Oil | 41.4 |
| Phenol formaldehyde rosin | 11.4 |
| Raw linseed oil | 47.2 |
| | 100.0 |

Mix the chinawood oil with the rosin. Heat to 510° F. with stirring. Maintain temperature and stirring for 1 hr., 3½ min. Add the linseed oil. Cool to ambient temperture.

Then mix together Parts A and B in the following proportions:

| | % by wt. |
|---|---|
| Part A | 54.9 |
| Part B | 45.1 |
| | 100.0 |

EXAMPLE 2

The following formulation is of an ink including both the silver color and a fluorescent material. Since aluminum powder has a considerable covering power, it tends to mask the fluorescent pigment. When the fluorescent pigment is increased to overcome that masking effect, it in turn tends to mask the specular reflection of the aluminum. Hence, the proportions of aluminum powder and fluorescent pigment are fairly sensitive and cannot be greatly varied from the proportions suggested. When using this pigment, it is desired that the counterfeit be detectable not only by the false color reproduction, but by the lack of a fluorescent characteristic in the reproduction. This fluorescent characteristic can, of course, be observed only under an ultraviolet light.

| Part A | % by Wt. |
|---|---|
| Synthetic Alkyd Varnish | 34.1 |
| Powdered Aluminum (95% passes 400 mesh screen) | 65.9 |
| | 100.0 |

| Part B | |
|---|---|
| Synthetic Alkyd Varnish | 46.8 |
| Magnesium carbonate | 12.9 |
| Fluorescent pigment | 36.8 |
| Lead/Manganese Drier | 3.5 |
| | 100.0 |

| Mix together | |
|---|---|
| Part A | 20.1 |
| Part B | 75.9 |
| | 100.0 |

Other conventional printing ink vehicles may be used in place of the synthetic alkyd varnish. The fluorescent pigment may be zinc sulfide or cadmium sulfide, or a mixture of those sulfides in any proportions. Other fluorescent pigments may be used.

I claim:

1. A document of value incapable of reproduction in true color by a color-analyzing-and-synthesizing copier, comprising:

a. a printable substrate having two overlapping but non-registering imprints thereon;

b. one of said imprints being in a color reproducible by said copier; and c. the other of said imprints being in an ink including a specularly reflective opaque coloring material, said other imprint being incapable of reproduction by said copier, said other imprint comprising:

1. a multiplicity of fine, closely spaced elements having a small dimension in at least one direction and thereby difficult to reproduce by hand; and
2. an area having dimensions in each of two mutually perpendicular directions which are substantially greater than said small dimension, said area being free of any overprint and thereby readily observable.

2. A document of value as in claim 1, in which said other imprint overlaps said one imprint.

3. A document of value as in claim 1, in which said specularly reflective coloring material includes aluminum powder in the form of flakes, many of which lie flat on the surface of the imprint and parallel to the substrate so as to reflect light impinging on the printed surface of the substrate.

4. A document of value as in claim 3, including a fluorescent material mixed with said specularly reflective coloring material, said fluorescent material being incompletely masked by said reflective material and having a fluorescent characteristic not reproducible by said copier.

5. A document of value as in claim 1, in which said elements comprise a network of intersecting lines.

6. A document of value incapable of reproduction in true color by a color-analyzing-and-synthesizing copier, comprising:

a. a printable substrate having two overlapping but non-registering imprints thereon;

b. one of said imprints being in a color reproducible by said copier; and c. the other of said imprints being in an ink including a white metallic pigment having a luster incapable of reproduction by said copier, said other imprint comprising:

1. a multiplicity of fine, closely spaced elements having a small dimension in at least one direction and thereby difficult to reproduce by hand; and 2. an area having dimensions in each of two mutually perpendicular directions which are substantially greater than said small dimension, said area being free of any overprint and thereby readily observable.

7. A document of value incapable of reproduction in true color by a color-analyzing-and synthesizing copier, comprising:

a. a printable substrate having two overlapping but non-registering imprints thereon;

b. one of said imprints being in a color reproducible by said copier; and c. the other of said imprints being in an ink including a specularly reflective opaque coloring material and a fluorescent material incompletely masked by said reflective material and having fluorescent characteristics not reproducible by said copier, said reflective material having a color incapable of reproduction by said copier.

* * * * *